US006272714B2

(12) United States Patent
Beals

(10) Patent No.: US 6,272,714 B2
(45) Date of Patent: Aug. 14, 2001

(54) TOOTHBRUSH

(75) Inventor: Donna Beals, Sunnyville, CA (US)

(73) Assignee: Gillette Canada Company, Mississiouga Ontario (CA)

( * ) Notice: Subject to any disclaimer, the term of this patent is extended or adjusted under 35 U.S.C. 154(b) by 0 days.

(21) Appl. No.: 09/280,871

(22) Filed: Mar. 29, 1999

(51) Int. Cl.[7] ..... A46B 9/04
(52) U.S. Cl. ..... 15/167.1; 15/207.2; 15/DIG. 5
(58) Field of Search ..... 15/167.1, 207.2, 15/DIG. 5; D4/104, 105, 130

(56) References Cited

U.S. PATENT DOCUMENTS

| | | | | |
|---|---|---|---|---|
| 164,353 | * | 6/1875 | Wayne . | |
| D. 334,288 | | 3/1993 | Witzig-Jaggi . | |
| 2,242,743 | | 5/1941 | Brown . | |
| 3,085,273 | | 4/1963 | Cowan . | |
| 3,229,318 | * | 1/1966 | Clemens | 15/207.2 |
| 3,346,900 | * | 10/1967 | Stewart | 15/207.2 |
| 4,010,509 | * | 3/1977 | Huish | 15/DIG. 5 |
| 4,081,876 | | 4/1978 | Pugh . | |

FOREIGN PATENT DOCUMENTS

| | | |
|---|---|---|
| 4412301 | 10/1995 | (DE) . |
| 683311 | 6/1930 | (FR) . |
| 2624360 | 6/1989 | (FR) . |
| 8500178 | 8/1986 | (NL) . |

* cited by examiner

*Primary Examiner*—Randall E. Chin
(74) *Attorney, Agent, or Firm*—David A. Howley

(57) ABSTRACT

A toothbrush includes a handle, a head extending from the handle, and a tuft of bristles extending from the head. The tuft is inclined such that the angle of inclination is an acute angle relative to a surface of the head through which the tuft extends. The bristles have free ends which define a plane, the plane being other than perpendicular to a direction in which the tuft extends from the head. The plane is inclined towards the same direction in which the tuft is inclined.

4 Claims, 6 Drawing Sheets

TOOTHBRUSH

FIELD OF THE INVENTION

The invention relates generally to the field of oral are, and in particular to toothbrushes.

BACKGROUND OF THE INVENTION

U.S. Pat. No. 2,242,743 discloses a toothbrush having a handle 12, a head 14, and a plurality of tufts 16 of bristles which extend outward from the head. The tufts are positioned at an acute or obtuse angle with respect to the handle and head. The bristles provide a series of transverse, broad, inverted V-shaped areas on the working surface 18. The free ends of the bristles of each tuft form a surface which is inclined away from the direction in which the tuft is inclined.

U.S. Pat. No. 3,085,273 discloses a toothbrush having a handle 10 with an elongated head portion 12 formed integrally with the head. Bristles 14 are mounted in the head portion and are formed in tufts 15. The tufts are arranged in parallel rows 16, 16' longitudinally of the head and inclined in the direction of the rows. The free end of the bristles of each tuft define a plane which is perpendicular to the direction in which the tuft extends from the head.

SUMMARY OF THE INVENTION

Briefly summarized, according to one aspect of the present invention, a toothbrush includes a handle, a head extending from the handle, and a tuft of bristles extending from the head. The tuft is inclined toward the handle such that the angle of inclination is an acute angle relative to a surface of the head through which the tuft extends. The bristles have free ends which define a plane, the plane being other than perpendicular to a direction in which the tuft extends from the head. A face of the plane is tilted towards the handle.

These and other aspects and features of the present invention will be more clearly understood and appreciated from a review of the following detailed description of the preferred embodiments and appended claims, and by reference to the accompanying drawings.

DETAILED DESCRIPTION OF THE INVENTION

Figure 1:
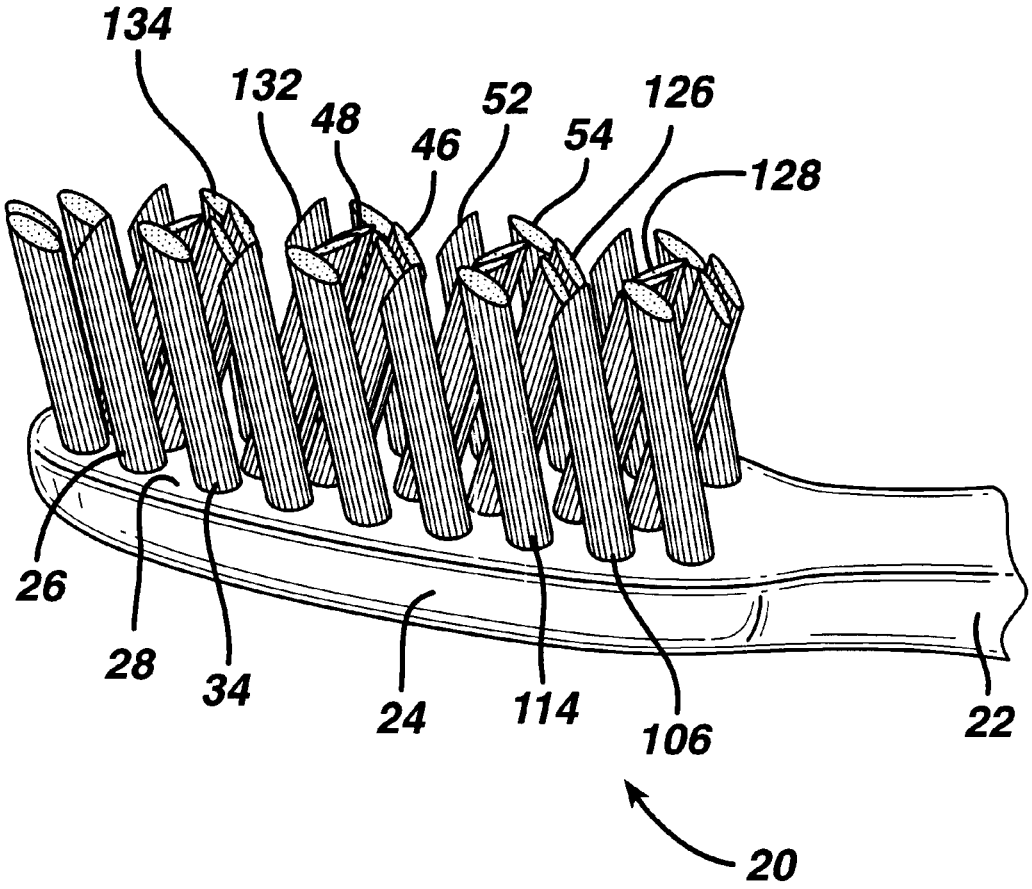
FIG. 1 is a perspective view as seen from the top, front and left side of a brush bristle pattern.
Figure 2:
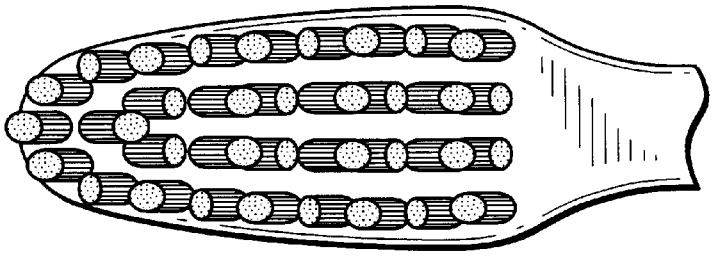
FIG. 2 is a top plan view thereof.
Figure 3:
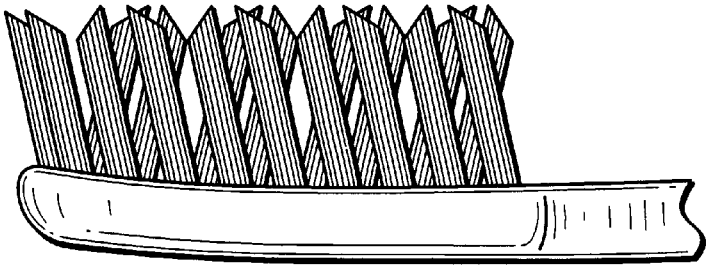
FIG. 3 is a left side elevational view thereof, the right side elevation being a mirror image thereof.
Figure 4:
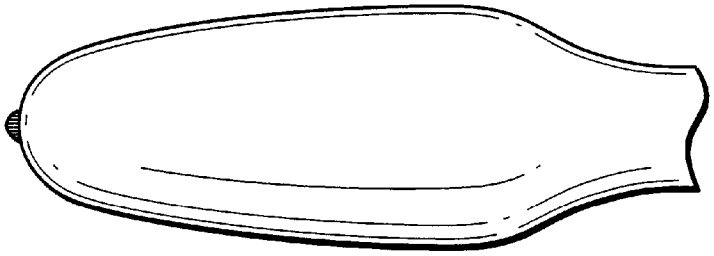
FIG. 4 is a bottom plan view thereof.
Figure 5:
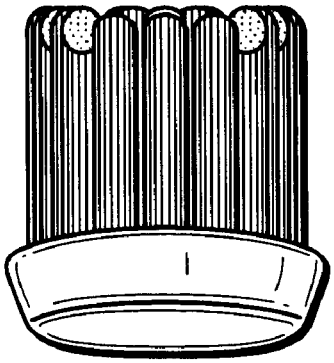
FIG. 5 is a rear elevational view thereof.
Figure 6:
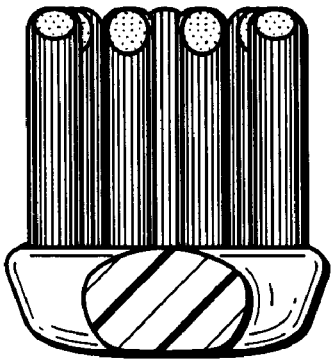
FIG. 6 is a front elevational view thereof.

Beginning with FIGS. 1–6, a toothbrush 20 includes a handle 22 (only a portion thereof being shown in the drawings) and a head 24 extending from the handle. A tuft of bristles 26 extends from head 24 and is inclined away from handle 22 such that the angle of inclination is an acute angle relative to a surface 28 of the head through which the tuft extends. The bristles of tuft 26 have free ends which define a plane 30, the plane being other than perpendicular to a direction 32 (see FIG. 3) in which the tuft extends from the head. A face of plane 30 is inclined away from the handle.

A second tuft of bristles 34 extends from head 24, the second tuft being adjacent tuft 26 and being inclined in the same direction as tuft 26. The angle of inclination of tuft 34 is an acute angle relative to surface 28. The bristles of tuft 34 have free ends which define a plane 36, this plane being other than perpendicular to direction 32 in which tuft 34 extends from head 24. A face of plane 36 is inclined away from tuft 26. A face of plane 30 of tuft 26 is inclined away from tuft 34. Tuft 26 and tuft 34 are arranged in a row 37 which is oriented substantially along a longest dimension 38 of head 24.

Third and fourth tufts of bristles 40 and 42 correspond as previously described respectively to tuft 26 and second tuft 34 of bristles except that third and fourth tufts 40, 42 are inclined in substantially the opposite direction (towards handle 22) to tuft 26 and second tuft 34. Third and fourth tufts 40, 42 are arranged in a second row 44 of tufts which is adjacent to row 37 of tuft 26 and second tuft 34.

Fifth and sixth tufts of bristles 46, 48 correspond as previously described respectively to the third 40 and fourth 42 tufts of bristles. The fifth and sixth tufts are arranged in a third row 50 of tufts which is adjacent to the second row 44 of tufts.

Seventh and eighth tufts 52, 54 of bristles correspond as previously described respectively to tuft 26 and second tuft 34 of bristles. The seventh and eighth tufts are arranged in a fourth row of tufts 56 which is adjacent to third row of tufts 50.

Figure 7:
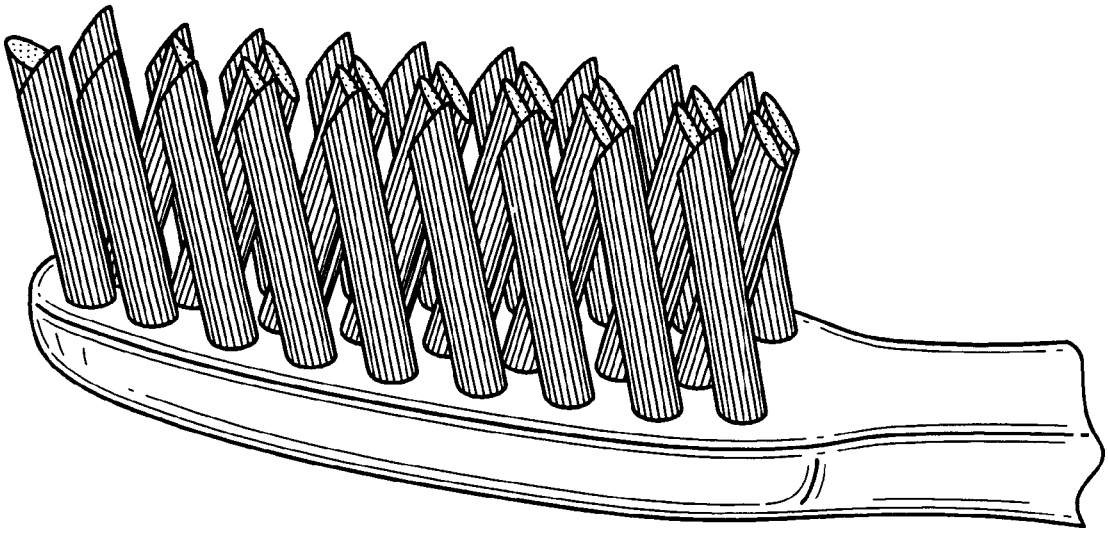
FIG. 7 is a perspective view as seen from the top, front and left side of a second embodiment of a brush bristle pattern.
Figure 8:
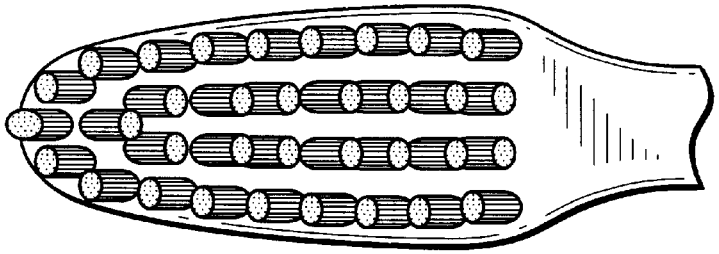
FIG. 8 is a top plan view thereof.
Figure 9:
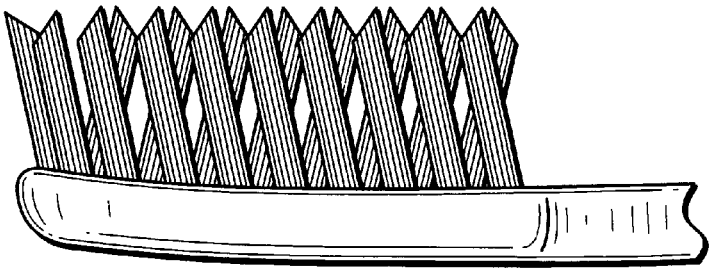
FIG. 9 is a left side elevational view thereof, the right side elevation being a mirror image thereof.
Figure 10:
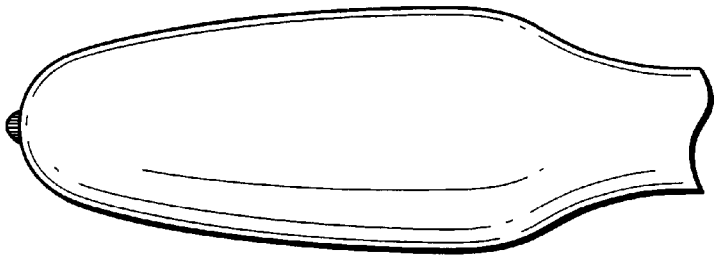
FIG. 10 is a bottom plan view thereof.
Figure 11:
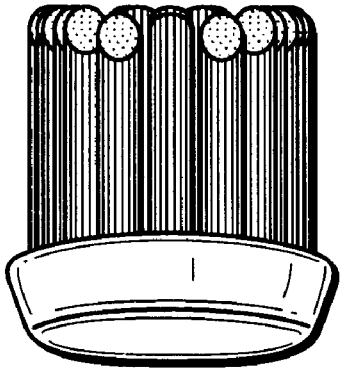
FIG. 11 is a rear elevational view thereof.
Figure 12:
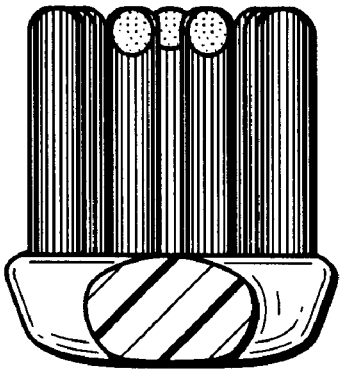
FIG. 12 is a front elevational view thereof

Turning to FIGS. 7–12, a second embodiment of the invention will be described. A toothbrush 60 includes a handle 62 (only a portion thereof being shown in the drawings) and a head 64 extending from the handle. A tuft of bristles 66 extends from head 64 and is inclined away from handle 62 such that the angle of inclination is an acute angle relative to a surface 68 of the head through which the tuft extends. The bristles of tuft 66 have free ends which define a plane 70, the plane being other than perpendicular to a direction 72 (see FIG. 9) in which the tuft extends from the head. A face of plane 70 is inclined away from handle 62.

A second tuft of bristles 74 extends from head 64, the second tuft being adjacent tuft 66 and being inclined in the same direction as tuft 66. The angle of inclination of tuft 74 is an acute angle relative to surface 68. The bristles of tuft 74 have free ends which define a plane 76, this plane being other than perpendicular to direction 72 in which tuft 74 extends from head 64. A face of plane 76 is inclined away from tuft 66. A face of plane 70 of tuft 66 is inclined toward tuft 74. Tuft 66 and tuft 74 are arranged in a row of tufts 77 which is oriented substantially along a longest dimension 78 of head 64.

Third and fourth tufts of bristles 80 and 82 correspond as previously described respectively to tuft 66 and second tuft 74 of bristles except that third and fourth tufts 80, 82 are inclined in substantially the opposite direction (towards handle 62) to tuft 66 and second tuft 74. Third and fourth tufts 80, 82 are arranged in a second row 84 of tufts which is adjacent to row 77 of tuft 66 and second tuft 74.

Fifth and sixth tufts of bristles 86, 88 correspond as previously described respectively to the third 80 and fourth 82 tufts of bristles. The fifth and sixth tufts are arranged in a third row 90 of tufts which is adjacent to the second row 84 of tufts.

Seventh and eighth tufts 92, 94 of bristles correspond as previously described respectively to tuft 66 and second tuft 74 of bristles. The seventh and eighth tufts are arranged in a fourth row of tufts 96 which is adjacent to third row of tufts 90.

Referring back to FIGS. 1–6, further tufts on toothbrush 20 will be described. A tuft of bristles 106 extends from head 24 and is inclined away from handle 22 such that the angle of inclination is an acute angle relative to a surface 28 of the head through which the tuft extends. The bristles of tuft 106 have free ends which define a plane 110, the plane being other than perpendicular to a direction 32 (see FIG. 3) in which tuft 106 extends from the head. A face of plane 110 is inclined away from handle 22.

A second tuft of bristles 114 extends from head 24, the second tuft being adjacent tuft 106 and being inclined in the same direction as tuft 106. The angle of inclination of tuft 114 is an acute angle relative to surface 28. The bristles of tuft 114 have free ends which define a plane 116, this plane being other than perpendicular to direction 32 in which tuft 114 extends from head 24. A face of plane 116 is inclined towards tuft 106. A face of plane 110 of tuft 106 is inclined towards tuft 114. Tuft 106 and tuft 114 are arranged in row of tufts 37.

Third and fourth tufts of bristles 120 and 122 correspond as previously described respectively to tuft 106 and second tuft 114 of bristles except that third and fourth tufts 120, 122 are inclined in substantially the opposite direction (towards handle 22) to tuft 106 and second tuft 114. Third and fourth tufts 120, 122 are arranged in a second row 44 of tufts which is adjacent to row 37 of tuft 106 and second tuft 114.

Fifth and sixth tufts of bristles 126, 128 correspond as previously described respectively to the third 120 and fourth 122 tufts of bristles. The fifth and sixth tufts are arranged in a third row 50 of tufts which is adjacent to the second row 44 of tufts.

Seventh and eighth tufts 132, 134 of bristles correspond as previously described respectively to tuft 106 and second tuft 114 of bristles. The seventh and eighth tufts are arranged in a fourth row of tufts 56 which is adjacent to third row of tufts 50.

The invention has been described with reference to preferred embodiments. However, it will be appreciated that variations and modifications can be effected by a person of ordinary skill in the art without departing from the scope of the invention.

What is claimed is:

1. A toothbrush, comprising:

a handle;

a head extending from the handle;

a tuft of bristles extending from the head, the tuft being inclined towards the handle such that the angle of inclination is an acute angle relative to a surface of the head through which the tuft extends, the bristles having free ends which define a plane, the plane being other than perpendicular to a direction in which the tuft extends from the head, a face of the plane being inclined towards the handle;

a second tuft of bristles extending from the head, the second tuft being adjacent the tuft and being inclined in the same direction as the tuft, the angle of inclination of the second tuft being an acute angle relative to a surface of the head through which the second tuft extends, the bristles of the second tuft having free ends which define a plane, this plane being other than perpendicular to a direction in which the second tuft extends from the head, a face of this plane being inclined away from the handle;

third and fourth tufts of bristles which are substantially the same respectively as the tuft and second tuft of bristles, the third and fourth tufts being inclined away from the handle, the third and fourth tufts being arranged in a second row which is adjacent to the row of the tuft and second tuft;

fifth and sixth tufts of bristles which are substantially the same respectively as the third and fourth tufts of bristles, the fifth and sixth tufts being arranged in a third row which is adjacent to the second row of tufts.

2. The toothbrush of claim 1, further comprising:

seventh and eighth tufts of bristles which are substantially the same respectively as the tuft and second tuft of bristles, the seventh and eighth tufts being arranged in a fourth row which is adjacent to the third row of tufts.

3. A toothbrush, comprising:

a handle;

a head extending from the handle; and a tuft of bristles extending from the head, the tuft being inclined away from the handle such that the angle of inclination is an acute angle relative to a surface of the head through which the tuft extends, the bristles having free ends which define a plane, the plane being other than perpendicular to a direction in which the tuft extends from the head, a face of the plane being inclined away from the handle;

a second tuft of bristles extending from the head, the second tuft being adjacent the tuft and being inclined in the same direction as the tuft, the angle of inclination of the second tuft being an acute angle relative to a surface of the head through which the second tuft extends, the bristles of the second tuft having free ends which define a plane, this plane being other than perpendicular to a direction in which the second tuft extends from the head, a face of this plane being inclined away from the handle;

third and fourth tufts of bristles which are similar to the tuft and second tuft of bristles, the third and fourth tufts each having a face of the plane defined by the free bristle ends inclined towards the handle, the third and fourth tufts being inclined towards the handle, the third and fourth tufts being arranged in a second row which is adjacent to the row of the tuft and second tuft;

fifth and sixth tufts of bristles which are substantially the same respectively as the third and fourth tufts of bristles, the fifth and sixth tufts being arranged in a third row which is adjacent to the second row of tufts.

4. The toothbrush of claim 3, further comprising:

seventh and eighth tufts of bristles which are substantially the same respectively as the tuft and second tuft of bristles, the seventh and eighth tufts being arranged in a fourth row which is adjacent to the third row of tufts.

* * * * *